US011147306B2

(12) United States Patent
Caprini

(10) Patent No.: US 11,147,306 B2
(45) Date of Patent: Oct. 19, 2021

(54) APPARATUS AND METHOD FOR FORMING FILTER RODS

(71) Applicant: Philip Morris Products S.A., Neuchâtel (CH)

(72) Inventor: Gianni Caprini, Bologna (IT)

(73) Assignee: Philip Morris Products S.A., Neuchâtel (CH)

( * ) Notice: Subject to any disclaimer, the term of this patent is extended or adjusted under 35 U.S.C. 154(b) by 238 days.

(21) Appl. No.: 16/497,587

(22) PCT Filed: Mar. 19, 2018

(86) PCT No.: PCT/EP2018/056790
§ 371 (c)(1),
(2) Date: Sep. 25, 2019

(87) PCT Pub. No.: WO2018/177782
PCT Pub. Date: Oct. 4, 2018

(65) Prior Publication Data

US 2021/0282452 A1 Sep. 16, 2021

(30) Foreign Application Priority Data

Mar. 27, 2017 (EP) ..... 17163140

(51) Int. Cl.
*A24D 3/02* (2006.01)
*A24D 3/17* (2020.01)

(52) U.S. Cl.
CPC ..... *A24D 3/0237* (2013.01); *A24D 3/0204* (2013.01); *A24D 3/0287* (2013.01); *A24D 3/17* (2020.01)

(58) Field of Classification Search
CPC ..... A24D 3/0237; A24D 3/17; A24D 3/0204; A24D 3/0287; B31B 2150/002
See application file for complete search history.

(56) References Cited

U.S. PATENT DOCUMENTS 3,254,373 A * 6/1966 Pannill, Jr. ..... A24D 3/0204 19/65 T
3,509,799 A * 5/1970 Hartbauer ..... B29C 66/1122 493/197

(Continued)

FOREIGN PATENT DOCUMENTS

CN 104585877 A 5/2015
DE 103 54 924 A1 6/2005

(Continued)

OTHER PUBLICATIONS

International Preliminary Report on Patentability and Written Opinion dated Oct. 10, 2019 in PCT/EP2018/056790.

(Continued)

*Primary Examiner* — Thomas M Wittenschlaeger
(74) *Attorney, Agent, or Firm* — Oblon, McClelland, Maier & Neustadt, L.L.P.

(57) ABSTRACT

An apparatus for forming filter rods for aerosol-generating articles is provided, including a first source and a second source, the first source being configured to supply filter material in a form of a first tow, and the second source being configured to supply filter material in a form of a second tow; a single driven delivery roller configured to advance the first tow and the second tow; and an extrusion tool configured to process the first tow and the second tow, the delivery roller being arranged such that the first and the second tows are advanced from the first and the second sources toward the extrusion tool only by the delivery roller, and the extrusion tool is further configured to process several sources of filter material simultaneously to create one filter rod. A method for forming filter rods for aerosol-generating articles is also provided.

10 Claims, 1 Drawing Sheet

(56) References Cited

U.S. PATENT DOCUMENTS

| | | | | | |
|---|---|---|---|---|---|
| 3,533,416 | A * | 10/1970 | Brooks | A24D 3/0283 | 131/342 |
| 3,579,623 | A | 5/1971 | Thomson et al. | | |
| 3,946,097 | A * | 3/1976 | Takahashi | B29C 70/50 | 264/510 |
| 7,547,271 | B2 * | 6/2009 | Kato | A24D 3/0225 | 493/4 |
| 7,811,220 | B2 * | 10/2010 | Wolff | A24D 3/0204 | 493/49 |
| 2005/0288163 | A1 * | 12/2005 | Caenen | D01F 2/28 | 493/39 |
| 2006/0194683 | A1 * | 8/2006 | Tobias | A24D 3/0204 | 493/39 |
| 2007/0157938 | A1 | 7/2007 | Wolff | | |

FOREIGN PATENT DOCUMENTS

| | | | | | |
|---|---|---|---|---|---|
| DE | 10 2010 045 648 | A1 | | 3/2012 | |
| DE | 102010063564 | A1 * | | 6/2012 | A24D 3/10 |
| DE | 102010063593 | A1 * | | 6/2012 | A24D 3/0208 |
| DE | 20 2012 003 924 | U1 | | 8/2012 | |
| DE | 202012003924 | U1 * | | 8/2012 | A24D 3/0204 |
| DE | 10 2013 222 055 | A1 | | 4/2015 | |
| EP | 1 625 799 | A1 | | 2/2006 | |
| EP | 1625799 | A1 * | | 2/2006 | A24D 3/02 |
| EP | 1 847 186 | A1 | | 10/2007 | |
| GB | 2 265 298 | A | | 9/1993 | |
| RU | 2 328 953 | C1 | | 7/2008 | |
| RU | 2011 142 809 | A | | 5/2013 | |
| WO | WO 2014/125096 | A1 | | 8/2014 | |
| WO | WO-2014125096 | A1 * | | 8/2014 | A24D 3/02 |

OTHER PUBLICATIONS

Office Action dated Oct. 29, 2020 in corresponding Japanese Patent Application No. 2019-553443 (English Translation only), 3 pages.
Decision to Grant dated May 25, 2020 in Russian Patent Application No. 2019134195 (submitting English translation only), 5 pages.
International Search Report dated Jun. 13, 2018 in PCT/EP2018/056790 filed on Mar. 19, 2018.
European Search Report dated May 16, 2017 in European Application No. 17163140.1 filed on Mar. 27, 2017.

* cited by examiner

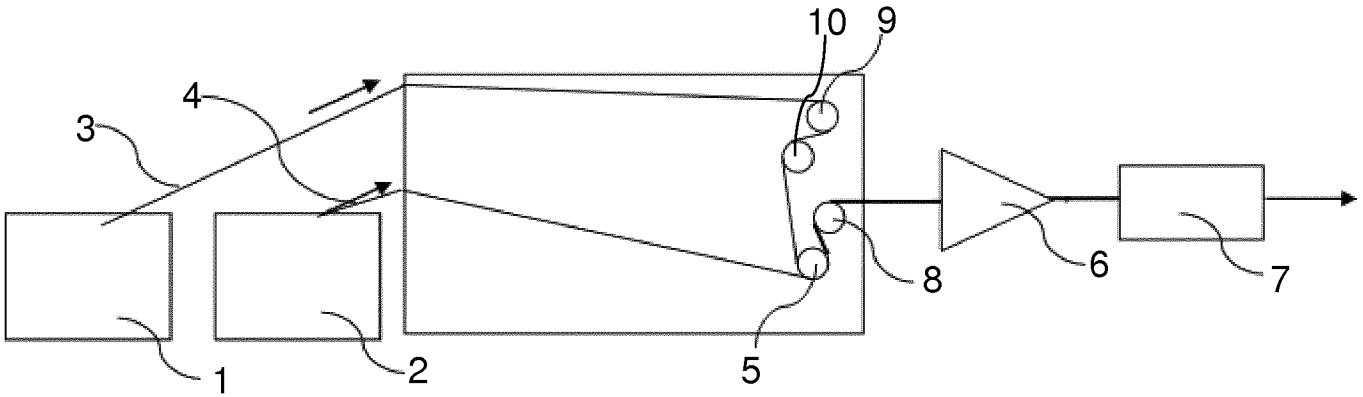
1
2
3
4
5
6
7
8
9
10

APPARATUS AND METHOD FOR FORMING FILTER RODS

The present invention relates to an apparatus for forming filter rods for aerosol-generating articles.

Filter rods may be formed from fibrous filter material by an extrusion technique. In some cases, components of the fibrous filter material needs to be solidified during the extrusion process, for instance by heat. The fibers are continuously advanced until they solidify, which prevent them to get volume adequate for a filter rod. To balance this lack of volume, more than one source of fibrous filter material may be processed simultaneously in the same extruding tool to create one filter rod.

To process more than one tow, a solution is to put in parallel, before the extruding tool, as many delivery rollers as there are tows so as to advance the fibers individually. However, in case of different speeds between the delivery rollers, the loading of the material into the extruding tool may not be stable.

In particular, the fibers may react to the strength applied to them by the delivery rollers. In case the delivery rollers have speeds which are not exactly the same, the strength applied to the tows will not be the same, and so the characteristics of the fibers entering into the extruding tool will not be the same, resulting in lower quality for the resulting filter rod. This drop in quality may be particularly important at the start of the extrusion process, until the delivery rollers synchronize to each other, possibly resulting in high waste each time the extrusion tool starts.

In order to satisfy the requirements of modern high-speed tipping machines, it is known to form filter rods for aerosol-generating articles from two sources of filter material. For example, GB 2 265 298 A discloses a machine for making filter rods. Two or more tows of fibrous filter material are simultaneously advanced along neighboring paths through several processing units into a rod forming unit to be converted into filter rods. The tows can be advanced side-by-side in a common plane or in several planes above each other. The tows are respectively transported by a common advancing mechanism including a pair of driven rollers.

It would be desirable to have an apparatus for forming filter rods which enables a more stable extrusion process of multiple filter tows.

According to first aspect of the invention there provided an apparatus for forming filter rods for aerosol-generating articles. The apparatus comprises a first and a second source, the first source being provided to supply filter material in the form of a first tow, and the second source being provided to supply filter material in the form of a second tow. The apparatus further comprises a single driven delivery roller for advancing the first tow and the second tow and an extrusion tool for processing the first tow and the second tow. The delivery roller is arranged such that the first and second tows are advanced from the first and second source towards the extrusion tool by the delivery roller only. The extrusion tool is configured to process several sources of filter material simultaneously to create one filter rod.

By providing a single driven delivery roller for advancing both tows, a more uniform draw strength acting upon the two tows may be ensured. Thus, the combined tows, which are advanced towards the extrusion tool, may be more uniformly processed without delivery variations in the used tows. Occurring waste upon starting of the extrusion process can be limited, since the single driven delivery roller is pulling the first and second tow with identical strength from the beginning of the extrusion process. Also, the quality of the produced filter rod may be increased, since the tows may be uniformly processed.

The apparatus may further comprise a first non-driven aligning roller. The first non-driven aligning roller may be arranged downstream of the delivery roller between the delivery roller and the extrusion tool. The first aligning roller may be provided to align the advanced first and second tow in the extrusion axis of the extrusion tool.

The extrusion axis of the extrusion tool may be defined by the barrel of the extrusion tool, i.e. by the extrusion direction. Thus, by means of the first aligning roller, the tows may be advanced straight into the extrusion tool to facilitate a more uniform extrusion process. The extrusion tool may be provided as a conventional extrusion tool with a funnel-shaped entrance followed by a straight barrel.

The first aligning roller and the delivery roller may be arranged such that the first and second tows are aligned in an s-shaped pathway between the entrance of the delivery roller and the exit of the first aligning roller. In that way, the surface area between the advanced first and second tows and the delivery roller may be increased. This may ensure that a sufficient draw strength can be conveyed from the delivery roller to the first and second tow.

The surface of the delivery roller may be treated to increase the friction between the surface of the delivery roller and the tows to be advanced. The surface of the delivery roller may be treated with a coating which increases the friction of the surface of the delivery roller. The surface shape of the delivery roller may additionally or alternatively be altered to increase the friction of the surface of the delivery roller. Exemplarily, small spikes or elevations may be provided on the surface of the delivery roller to increase the friction between the tows and the surface of the delivery roller.

The apparatus may further comprise second and third aligning roller for aligning the first tow before the first tow is fed into the delivery roller. By arranging these aligning rollers displaced with respect to a straight line between the delivery roller and the first source, the first tow may be delivered towards the delivery roller with an angle. This arrangement of the first and second aligning roller may ensure that the surface area between the first tow and the surface of the delivery roller may be increased. In this way, the draw strength conveyed by the delivery roller to the first tow may be suitably adjusted, preferably increased. Furthermore, the provision of second and third aligning roller may ensure that the first and second tow do not interact with each other before they are fed into the delivery roller. Thus, any interference between the first tow and the second tow before these tows are fed into the delivery roller may be avoided.

The second and third aligning roller may be arranged such that the pathway of the first tow between the first source and the entrance of the delivery roller may be provided as an s-shaped pathway. In this way, the contact area between the first tow and the second and third aligning roller may be increased so that the drawing action of the delivery roller may be better transferred towards the first tow and a safer alignment of the first tow may be facilitated.

Similar to the second and third aligning roller, aligning roller may be provided between the second source and the entrance of the delivery roller such that the second tow may be better aligned and delivered towards the delivery roller.

Also, more than two sources for filter tow may be provided. Preferably, aligning roller as described above may be provided to guide filter tow from multiple sources towards the delivery roller. When more than two sources for filter tow are provided, all of these tows may be drawn by means of the single delivery roller so that a more uniform draw strength may be ensured.

All of the aligning roller are non-driven roller so that the pulling of the first and second tows are only facilitated by means of the driven delivery roller.

When the first and second tows are delivered towards the delivery roller, the first and second tows, preferably by means of the aligning roller as described above, may be aligned with respect to each other such that the first and second tow overlay each other while being pulled by the delivery roller. In other words, before the first and second tows are delivered towards the delivery roller, these tows may not interact with each other. However, when these tows reach the delivery roller, they may be aligned overlaying each other and may both be pulled by the delivery roller together. Consequently, these tows may be more uniformly advanced towards the extrusion tool.

There is further provided a method for forming filter rods for aerosol-generating articles, comprising the steps of:

(a) providing, by means of a first source, filter material in the form of a first tow, and, by means of a second source, filter material in the form of a second tow, (b) advancing the first tow and the second tow only by means of a driven single delivery roller, and (c) extruding the first tow and the second tow in an extrusion tool.

According to an aspect of the invention, the method further may comprise the step of providing a first non-driven aligning roller downstream of the delivery roller between the delivery roller and the extrusion tool. The first aligning roller may be configured as described above.

The method may comprise the further step of providing second and third aligning roller as described above.

The invention will be further described, by way of example only, with reference to the accompanying drawing in which:

FIG. 1 shows an illustrative cross-sectional view of the inventive apparatus for forming filter rods for aerosol-generating articles.

The apparatus shown in FIG. 1 comprises a first source 1 and a second source 2. Both of these sources comprise filter material.

Cellulose acetate may be employed as the filter material. For the purpose of providing uniform density and overall cohesive character to the filler, the filaments may be subsequently treated with a plasticizer to thereby promote interfiber bonding of the various filaments comprising the tow. The tow may be comprised of a plurality of filaments of cellulose acetate extending longitudinally and coextensively of the tow mass. The cellulose acetate may have a total denier of 25,000 to 75,000 but more preferably in the range of 30,000 to 50,000 the foregoing being based on a fiber denier of about 1 to 16 and preferably 3 to 6 denier. Other materials are suitable for use as filler and can include polyalkenes, polyethylene, and paper tows.

As a preliminary to forming a filter rod, the filter material which is described in representative form as being a tow of filaments of cellulose acetate may be fed through a blooming and coating chamber (not shown) wherein the filaments may be coated with a plasticizer comprising by way of example, a solution of 3%-12% triacetin. The plasticizer may be employed to promote interfiber bonding in the tow at the points of crossing or contact of the respective fibers and thereby produces cohesiveness in the mass of the tow.

The filter material is pulled from the first source 1 and second source 2. In this regard, a first tow 3 is pulled from the first source 1 and a second tow 4 is pulled from the second source 2. The provision of two sources is to be understood illustrative. Multiple sources and respective multiple tows may be employed in the invention.

The first tow 3 and the second tow 4 are pulled by a single driven delivery roller 5. The delivery roller 5 may be driven by a conventional means such as an electromotor.

The delivery roller 5 is arranged such that the first tow 3 and the second tow 4 are both pulled by the delivery roller 5 from the first source 1 and the second source 2. Thus, a uniform pulling action is performed by the delivery roller 5 with respect to the tows 3, 4.

Before reaching the delivery roller 5, the tows 3, 4 are provided separate from each other and do not interact with each other. Upon reaching the delivery roller 5, the first tow 3 overlays the second tow 4 or the second tow 4 overlays the first tow 3. Thus, both tows, overlaying each other, are pulled by the delivery roller 5.

After being pulled by the delivery roller 5, the tows are together delivered towards an extrusion tool 6. The extrusion tool 6 is provided as a conventional extrusion tool comprising a funnel-shaped entrance (not shown) and a barrel (not shown) for extruding the first tow 3 and the second tow 4 and to create a filter rod which can be used in an aerosol-generating article.

After exiting the extrusion tool 6, the filter rod is conveyed by conventional conveying means 7 towards a filter making device (not shown).

Between the delivery roller 5 and the extrusion tool 6, a first non-driven aligning roller 8 may be provided. As can be seen in FIG. 1, the first aligning roller 8 is arranged such that the combined tows form an s-shaped pathway between the delivery roller 5 and the extrusion tool 6. The s-shaped pathway guarantees a high contact area between the tows 3, 4 and the surface of the delivery roller 5. Also, the tows 3, 4 are straight delivered into the extrusion tool 6 along the extrusion axis, thereby preventing a disturbance of the tows 3, 4.

To facilitate the separation of the first tow 3 and the second tow 4 before the delivery roller 5, a further second aligning roller 9 and a further third aligning roller 10 are provided between the first source 1 and the delivery roller 5. The second and third aligning roller 9, 10 facilitate the separation and proper alignment of the first tow 3 before the first tow 3 is fed towards the delivery roller 5. The second aligning roller 9 is displaced with respect to the pathway of the first tow 3 and the third aligning roller 10 so that the contact area between the first tow 1 and the second and third aligning roller 9, 10 as well as the delivery roller 5 is increased, thereby facilitating a safe aligning of the first tow 3 and an optimized pulling action of the delivery roller 5.

The above described features with respect to the invention are to be understood illustrative. The skilled person understands that the above described features can be combined with each other within the scope of the invention.

The invention claimed is:

1. An apparatus for forming filter rods for aerosol-generating articles, the apparatus comprising:

a first source and a second source, the first source being configured to supply filter material in a form of a first tow, and the second source being configured to supply filter material in a form of a second tow;

a single driven delivery roller configured to advance the first tow and the second tow; and an extrusion tool configured to process the first tow and the second tow, wherein the delivery roller is arranged such that the first and the second tows are advanced from the first and the second sources toward the extrusion tool only by the delivery roller, and wherein the extrusion tool is further configured to process several sources of filter material simultaneously to create one filter rod.

2. The apparatus according to claim 1, further comprising a first non-driven aligning roller arranged to align the first and the second tows in the extrusion tool after the first and the second tows are advanced by the delivery roller.

3. The apparatus according to claim 2, wherein the first non-driven aligning roller and the delivery roller are arranged such that the first and the second tows are aligned in an s-shaped pathway.

4. The apparatus according to claim 1, further comprising second and third non-driven aligning rollers configured to align the first tow, wherein the second and the third non-driven aligning rollers are arranged to align the first tow before the first tow is fed into the delivery roller.

5. The apparatus according to claim 4, wherein the second and the third non-driven aligning rollers and the delivery roller are arranged such that the first tow is aligned and overlaying the second tow when advanced by the delivery roller.

6. A method for forming filter rods for aerosol-generating articles, comprising the steps of:

(a) providing, by means of a first source, filter material in a form of a first tow, and, by means of a second source, filter material in a form of a second tow;

(b) advancing the first tow and the second tow only by means of a driven single delivery roller; and (c) extruding the first tow and the second tow in an extrusion tool, wherein several sources of the filter material are processed in the extrusion tool simultaneously to create one filter rod.

7. The method according to claim 6, further comprising providing a first non-driven aligning roller and arranging the first non-driven aligning roller to align the first and the second tows in the extrusion tool after the first and the second tows are advanced by the delivery roller.

8. The method according to claim 7, further comprising arranging the first non-driven aligning roller and the delivery roller such that the first and the second tows are aligned in an s-shaped pathway.

9. The method according to claim 6, further comprising providing second and third non-driven aligning rollers configured to align the first tow, and arranging the second and the third non-driven aligning rollers so as to align the first tow before the first tow is fed into the delivery roller.

10. The method according to claim 9, further comprising arranging the second and the third non-driven aligning rollers and the delivery roller such that the first tow is aligned and overlaying the second tow when advanced by the delivery roller.

* * * * *